US009188899B2

(12) United States Patent
Nagase et al.

(10) Patent No.: US 9,188,899 B2
(45) Date of Patent: Nov. 17, 2015

(54) CHARGING DEVICE, IMAGING CARTRIDGE AND IMAGE FORMING APPARATUS HAVING CHARGING DEVICE

(75) Inventors: Hisayoshi Nagase, Tokyo (JP); Yoshihiro Hattori, Tokyo (JP)

(73) Assignee: KONICA MINOLTA, INC. (JP)

( * ) Notice: Subject to any disclaimer, the term of this patent is extended or adjusted under 35 U.S.C. 154(b) by 27 days.

(21) Appl. No.: 13/608,024

(22) Filed: Sep. 10, 2012

(65) Prior Publication Data

US 2013/0064575 A1 Mar. 14, 2013

(30) Foreign Application Priority Data

Sep. 9, 2011 (JP) ..... 2011-197494

(51) Int. Cl.
*G03G 15/02* (2006.01)

(52) U.S. Cl.
CPC ..... *G03G 15/0291* (2013.01)

(58) Field of Classification Search
CPC ..... G03G 15/0291
USPC ..... 399/170–172
See application file for complete search history.

(56) References Cited

U.S. PATENT DOCUMENTS

| | | | | | |
|---|---|---|---|---|---|
| 3,800,153 | A | * | 3/1974 | Matsumoto et al. | 250/325 |
| 4,358,681 | A | * | 11/1982 | Ando | 250/324 |
| 5,324,942 | A | * | 6/1994 | Mishra et al. | 250/326 |
| 2008/0253805 | A1 | | 10/2008 | Yoshino | |

FOREIGN PATENT DOCUMENTS

| | | | |
|---|---|---|---|
| JP | 59-148071 | A | 8/1984 |
| JP | 02-213872 | A | 8/1990 |
| JP | H02212858 | A | 8/1990 |
| JP | 2008-262114 | A | 10/2008 |
| JP | 2008-298876 | A | 12/2008 |

OTHER PUBLICATIONS

Japanese Notification of Reasons for Refusal for Japanese Patent Application No. 2011-197494; Dispatch Dated: Oct. 1, 2013; with English Translation.

First Chinese Office Action corresponding to Application No. 201210330345.4; Date of Notification: Oct. 21, 2014, with English translation.

* cited by examiner

*Primary Examiner* — David Gray
*Assistant Examiner* — Sevan A Aydin
(74) *Attorney, Agent, or Firm* — Cantor Colburn LLP

(57) ABSTRACT

A charging device which includes a grid that has a curvature surface placed to face an outer circumferential surface of a photoconductive drum; a carrying member that carries the grid in a portion having a curvature to form the curvature surface of the grid; and position adjusting mechanisms that moves a position of the carrying member to adjust a position of the grid in a sub-scanning direction of the photoconductive drum, an imaging cartridge and an image forming apparatus having the same.

8 Claims, 13 Drawing Sheets

CHARGING DEVICE, IMAGING CARTRIDGE AND IMAGE FORMING APPARATUS HAVING CHARGING DEVICE

CROSS-REFERENCE TO RELATED APPLICATION

This application is based on Japanese Patent Application No. 2011-197494 filed on Sep. 9, 2011, the contents of which are incorporated herein by reference.

BACKGROUND

1. Technical Field

The present invention relates to a charging device, an imaging cartridge and an image forming apparatus having the charging device.

2. Description of Related Art

Recently, image forming apparatuses have been miniaturized for cost reduction and further speed increases and higher resolutions have been requested.

In order to realize miniaturization of the apparatus, a charging method has been adopted which places a curvature surface to face an outer circumferential surface of a photoconductive drum using a grid having the curvature surface in a charging device, charges the photoconductive drum, and improves charging characteristics. In the charging method using the grid having the curvature surface, the distance between the outer circumferential surface of the photoconductive drum and the grid curvature surface affects charging efficiency.

As a technique for improving the charging efficiency, as described in Unexamined Japanese Patent Publication No. 2008-298876, there is a technique which provides a gap roller carrying the photoconductive drum in the charging device, and relatively adjusts the distance between the photoconductive drum and the grid by changing the height of the gap roller.

However, although the charging efficiency can be improved by the technique of the related art mentioned above to some extent, it is impossible to improve the charging efficiency to a degree capable of higher resolutions, higher speeds and further miniaturization that can be required for the apparatus for the future.

SUMMARY

The present invention has been made to solve the aforementioned problems. That is, at least one of the curvature of the grid and the position of the grid to the sub scanning direction of the photoconductive drum is variable. Accordingly, an object thereof is to allow adjustment of the distance between the outer circumferential surface of the photoconductive drum and the curvature surface of the grid with even higher precision, improve the charging efficiency, and realize higher resolutions, higher speeds and further miniaturization of the image forming apparatus.

To achieve at least one of the above mentioned objects, a charging device reflecting one aspect of the present invention comprises a grid that has a curvature surface placed to face an outer circumferential surface of a photoconductive drum; a carrying member that carries the grid in a portion having a curvature to form the curvature surface of the grid; and a position adjusting mechanism that moves a position of the carrying member to adjust a position of the grid in a sub-scanning direction of the photoconductive drum.

To achieve at least one of the above mentioned objects, an imaging cartridge reflecting one aspect of the present invention comprises the charging device; an optical writing part that forms an electrostatic latent image on a photoconductive drum; and a developing device that develops the electrostatic latent image.

To achieve at least one of the above mentioned objects, an image forming apparatus reflecting one aspect of the present invention comprises a grid that has a curvature surface placed to face an outer circumferential surface of a photoconductive drum; a carrying member that carries the grid in a portion having a curvature to form the curvature surface of the grid; and a position adjusting mechanism that moves a position of the carrying member to adjust a position of the grid in the sub-scanning direction of the photoconductive drum.

The objects, features, and characteristics of this invention other than those set forth above will become apparent from the description given herein below with reference to preferred embodiments illustrated in the accompanying drawings.

DETAILED DESCRIPTION

A charging device, an imaging cartridge, and an image forming apparatus having the charging device according to the embodiments of the present invention will be described below in detail with reference to the accompanying drawings.

(First Embodiment)

Figure 1:
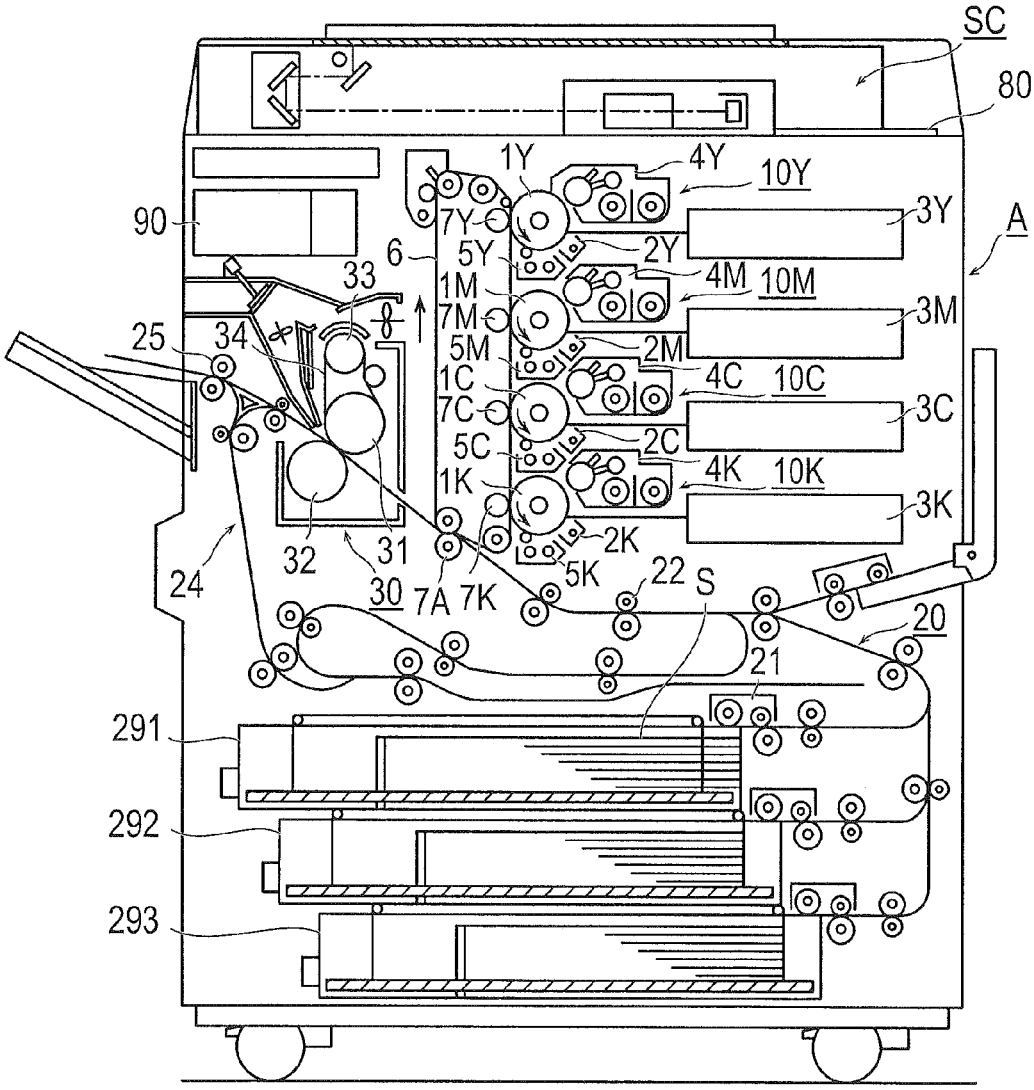
FIG. 1 is a diagram that describes an image forming apparatus according to a first embodiment of the present invention.

FIG. 1 is a diagram that describes an image forming apparatus according to a first embodiment of the present invention.

The image forming apparatus A is referred to as a tandem type color image forming apparatus and performs the color image formation using four sets of image forming parts.

An image of an original document mounted on an original document table is scanned and exposed by an optical system of a scanning exposure unit of an image scanning unit SC and is read by a line image sensor. Image information signal subjected to a photoelectric conversion is subjected to an analog processing, an A/D conversion, a shading correction, an image compression processing etc. in an image processing part (not shown), and then is input to an optical writing part of the image forming part.

Four sets of image forming part include an image forming part 10Y forming a yellow (Y) color image, an image forming part 10M forming a magenta (M) color image, an image forming part 10C forming a cyan (C) color image, and an image forming part 10K forming a black (K) color image, and reference numerals 10 common to each other have the reference numerals Y, M, C and K applied thereto indicating the colors to be formed.

The image forming part 10Y includes a photoconductive drum 1Y, a charging part 2Y, an optical writing part 3Y, a developing unit 4Y, and a drum cleaner 5Y placed around the photoconductive drum 1Y.

Similarly, the image forming part 10M includes a charging part (a charging device) 2M, an optical writing part 3M, a developing unit 4M and a drum cleaner 5M placed around a photoconductive drum 1M. The image forming part 10C includes a charging part 2*c*, an optical writing part 3C, a developing unit 4C, and a drum cleaner SC placed around a photoconductive drum 1C. The image forming part 10K includes a charging part 2K, an optical writing part 3K, a developing unit 4K, and a drum cleaner 5K around a photoconductive drum 1K.

The respective photoconductive drums 1Y, 1M, 1C, and 1K, the charging parts 2Y, 2M, 2C and 2K, the optical writing parts 3Y, 3M, 3C and 3K, the developing units 4Y, 4M, 4C and 4K, and the drum cleansers 5Y, 5M, 5C and 5K in the image forming parts 10Y, 10M, 10C and 10K have configurations of contents common to each other. Hereinafter, unless a particular distinction is necessary, the components are denoted without adding reference numerals Y, M, C and K.

The image forming part 10 charges the outer circumferential surface of the photoconductive drum 1 in the charging part 2, then, writes the image information signal on the photoconductive drum 1 in the optical writing part 3, and forms a latent image based on the image information signal on the photoconductive drum 1. Moreover, the latent image is developed by the developing unit 4, and a toner image which is a visible image is formed on the photoconductive drum 1.

The respective photoconductive drums 1Y, 1M, 1C and 1K of the image forming parts 10Y, 10M, 10C and 10K are each formed with the images of yellow (Y), magenta (M), cyan (C) and black (K).

The image forming part 10 could be constituted by an imaging cartridge that can be attached to and detached from the image forming apparatus A.

An intermediate transfer belt 6 is wound by a plurality of rollers and is supported in a runnable manner.

The respective color toner images formed by the image forming parts 10Y, 10M, 10C and 10K are sequentially transferred onto the running intermediate transfer belt 6 by primary transfer parts 7Y, 7M, 7C and 7K, and a color image of the toner constructed by superimposition of the respective color layers of Y (yellow), M (magenta), C (cyan) and K (black) is formed.

A paper conveying part 20 conveys a paper S. The paper S is stocked in paper feeding trays 291, 292 and 293, is fed by a first paper feeding part 21, and is conveyed to a secondary transfer part 7A via a resist roller 22, and a toner image on the intermediate transfer belt 6 is transferred onto the paper S. The secondary transfer part 7A is an example of transfer means, transfers the toner image onto the paper S, and conveys the paper S.

The toner image on the paper S is fixed to the paper S onto which the toner image is transferred by applying heat and pressure by a fixing device 30, and the paper S is discharged to the outside of the device via a fixing conveying roller 23 and a paper discharging roller 25.

The fixing device 30 has a fixing roller 31, a pressing roller 32, a heating roller 33, and a fixing belt 34. The fixing roller 31 is pressed by the pressing roller 32 and a substantially arc-shaped nip region is formed with a side mounted with the toner image on the paper S is convex. In the nip region, the paper S is interposed together with the heated fixing belt 34 heated via the heating roller 33. And, the toner of the toner image attached onto the paper S is heated and pressed, and the toner image is fixed to the paper S. The fixing device 30 is an example of the fixing means, fixes the toner image transferred onto the paper S by the secondary transfer part 7A to the paper S, and conveys the paper S.

The image forming apparatus A includes a paper inverting part 24A, guides the fixed paper from the fixing conveying roller 23 to the paper inverting part 24, so that converts the front side and back side thereof and discharges the paper, or forms the images on both sides of the paper.

It is possible to set a size, the number etc. of the paper S for image forming at an operation displaying part 80 equipped on an upper part of the main body of the image forming apparatus A.

The motion of the respective parts above for image forming and the motion of the respective parts for conveying the paper S are controlled by a control part 90. The control part 90 performs the control of the respective parts above and various calculations.

Figure 2:
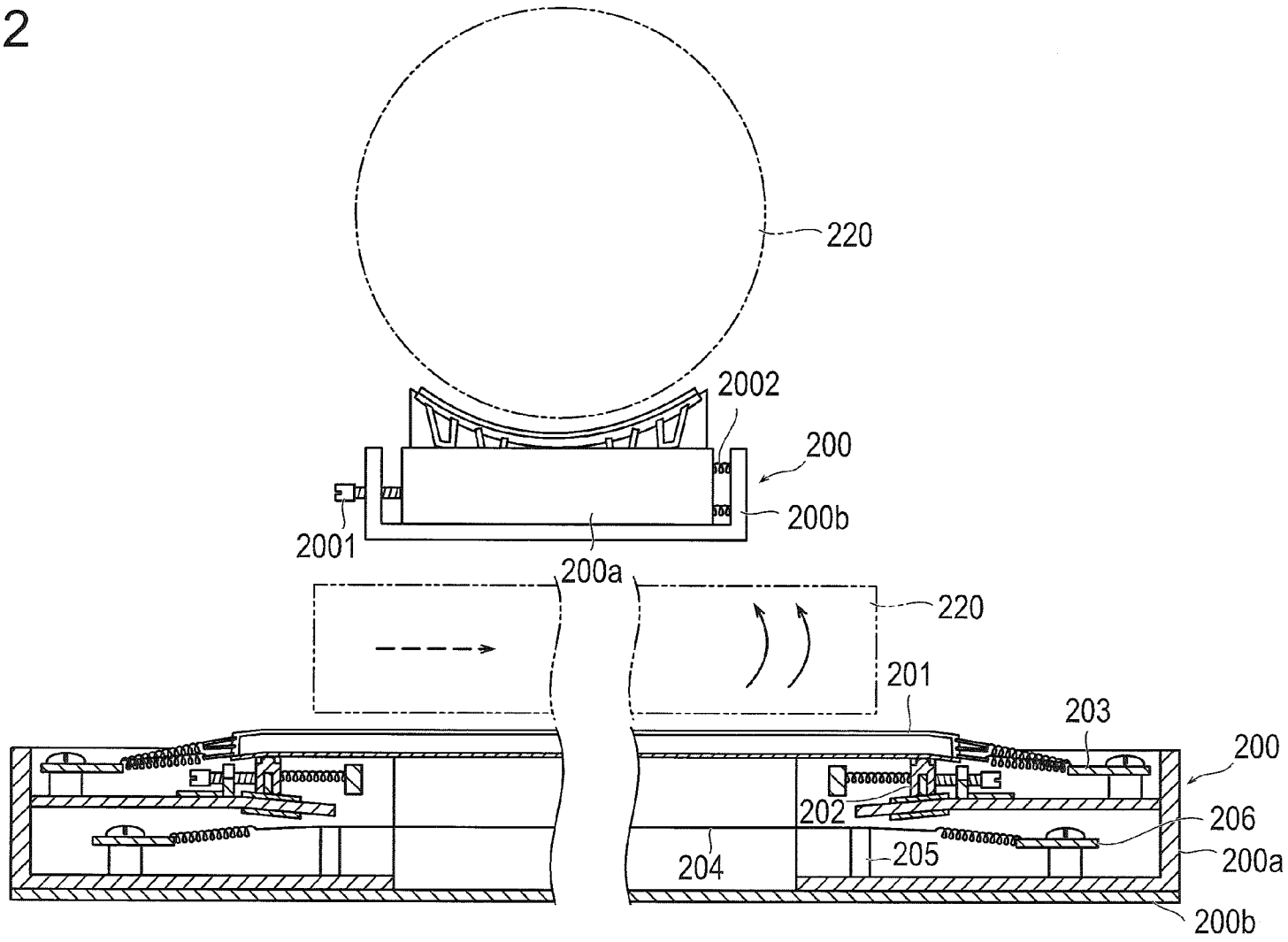
FIG. 2 is an explanatory diagram that shows a positional relationship between a charging device and a photoconductive drum according to the first embodiment of the present invention.
Figure 3:
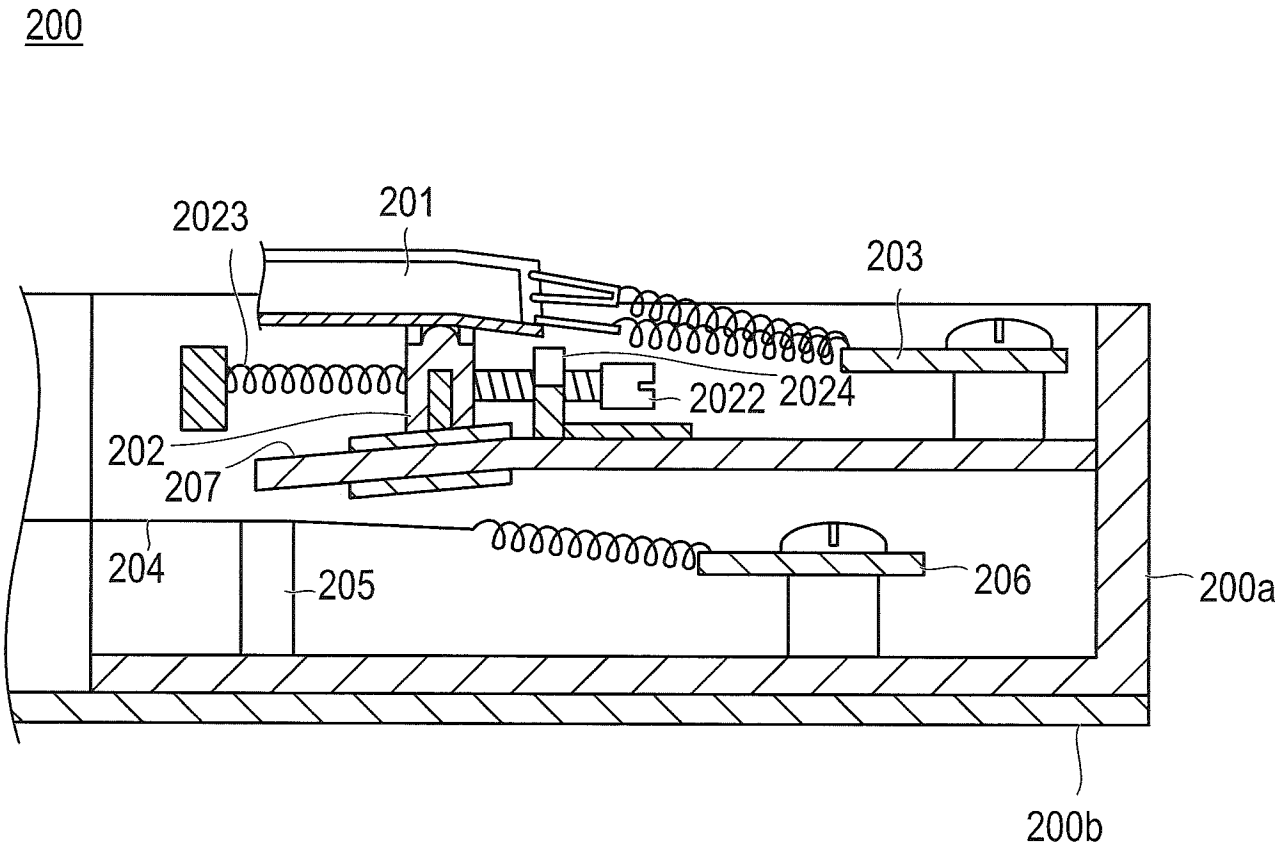
FIG. 3 is a cross-sectional view that shows a part of the charging device according to the first embodiment of the present invention.
Figure 4:
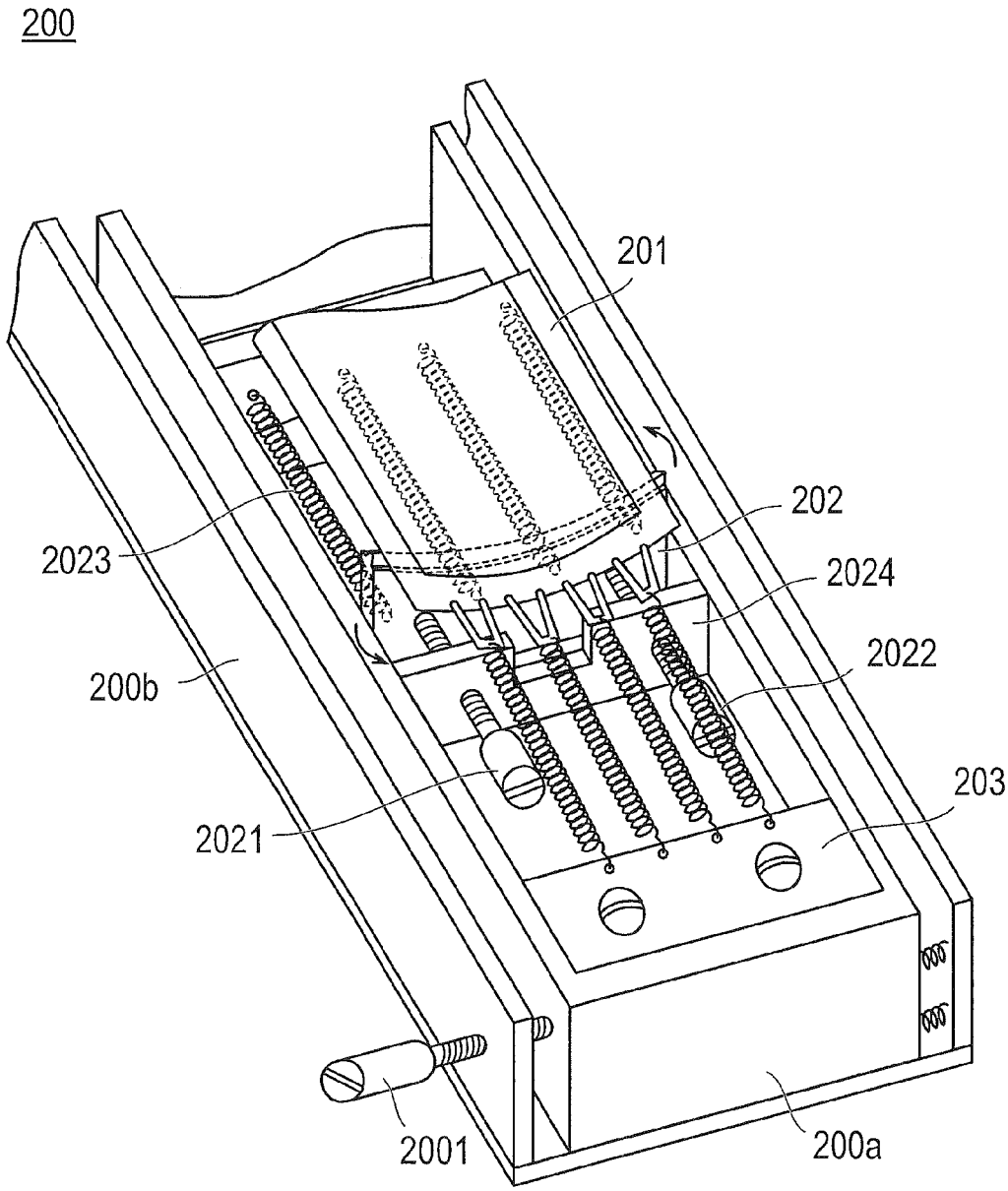
FIG. 4 is a perspective view that shows a part of the charging device according to the first embodiment of the present invention.

FIG. 2 is an explanatory diagram that shows a positional relationship between the charging device and the photoconductive drum according to the present embodiment. FIG. 3 is a cross-sectional view that shows a part of the charging device according to the present embodiment, and FIG. 4 is a perspective view that shows a part of the charging device according to the present embodiment.

A charging device 200 has a grid 201, a carrying member 202 carrying the grid 201, a supporting member 203 supporting the grid 201, a wire 204, a wire carrying member 205 carrying the wire 204, and a wire supporting member 206 supporting the wire 204.

A shield case 200*b* is provided with charging cases 200*a* at both ends thereof, and the grid 201 and the wire 204 is stretched between the charging cases 200*a*. The carrying member 202, the supporting member 203, the wire carrying member 205, and the wire supporting member 206 are carried or supported by the charging case 200*a*.

The grid 201 can be formed of a mesh pattern using cold rolled strip. The supporting member 203 supports both ends of the grid 201 via springs. The carrying member 202 has a fixed curvature shape and carries the grid 201 in a portion having a curvature shape. When the grid 201 is carried in the portion having the curvature of the carrying member 202, the grid 201 is molded by being pressed due to the tension thereof, and has the curvature surface formed by molding. In the portion carrying the grid 201 of the carrying member 202, a rib of a tip of R 0.3 to 1 is preferably provided so as to receive the grid 201 by a line profile. The grid 201 is configured so that the curvature surface is placed opposite to the outer circumferential surface of the photoconductive drum 220.

The mesh pattern of the grid 201 is preferably a pattern that has low rigidity in the sub-scanning direction of the photoconductive drum 220. In case the rigidity of the photoconductive drum 220 of the grid 201 in the sub-scanning direction is high, the curvature shape is opened due to the rigidity in the center of the grid 201, and both end parts in the sub-scanning direction may be adversely separated from the photoconductive drum 220. The sub-scanning direction is a direction indicated by a solid arrow in FIG. 2 and is a rotational direction of the photoconductive drum 220. In addition, a direction indicated by a dotted arrow in FIG. 2 is the main scanning direction.

Figure 5:
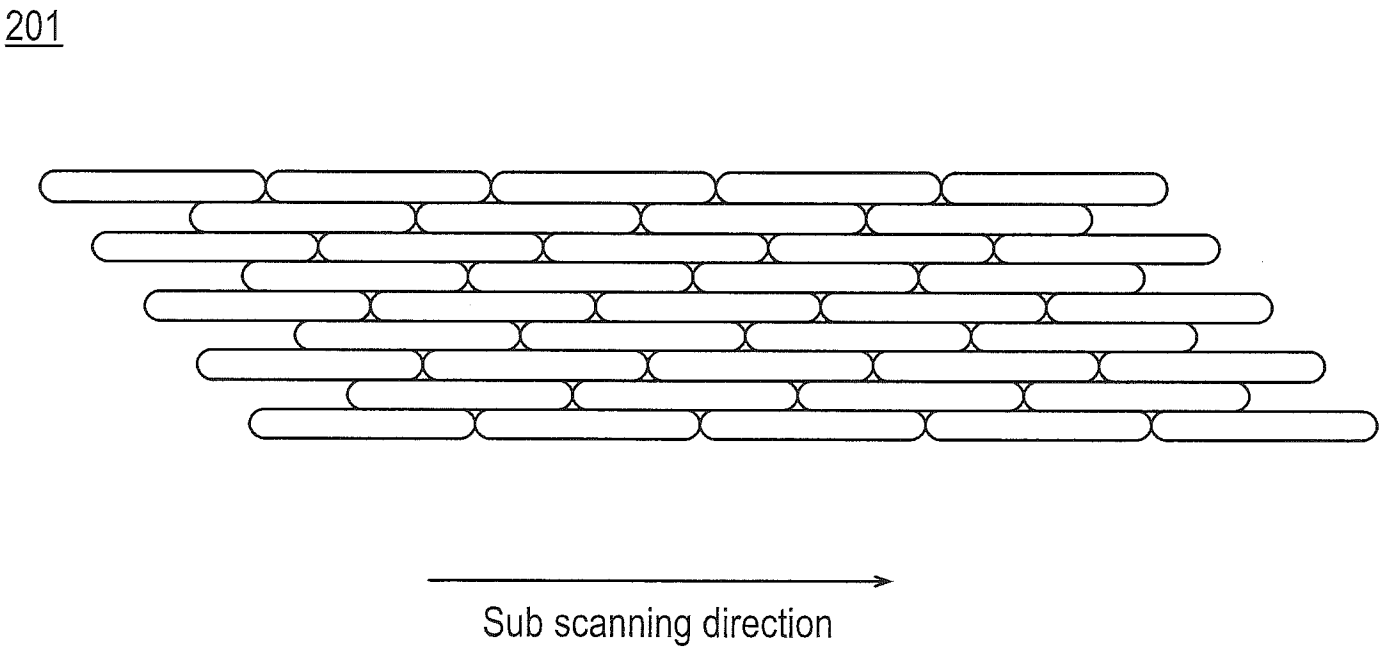
FIG. 5 is a diagram that shows an example of a mesh pattern of a grid having a low rigidity in the sub-scanning direction.

FIG. 5 is a diagram that shows an example of the mesh pattern of the grid having a low rigidity in the sub-scanning direction. As shown in FIG. 5, when the mesh pattern has a shape that is long in the sub-scanning direction, the mesh gap in the sub-scanning direction is increased, and thus the rigidity of the grid 201 in the sub-scanning direction can be lowered. On the contrary, since the rigidity of the grid 201 in the sub-scanning direction is increased in the grid 201 having the narrow mesh gap in the sub-scanning direction and the grid 201 of the mesh pattern having a sub-scanning direction component in the mesh pattern as in a slope mesh pattern in the sub-scanning direction, the grid 201 having such a mesh pattern is not preferable.

In addition, if the grid 201 is constituted by extending the wire grid in a cylindrical shape using tungsten having a diameter of 50 μm, it is possible to lower rigidity of the grid 201 in the sub-scanning direction.

As shown in FIG. 3, the supporting member 203 is fixed to the charging case 200*a*. The carrying member 202 is slidably supported to a sloped surface 207 of a plate-like member tilted to the surface perpendicular to a normal line of the outer circumferential surface of the photoconductive drum 220 and fixed to the charging case 200*a*, and rotatably supported to the sloped surface 207 around the normal line of the outer circumferential surface of the photoconductive drum 220. The rotatable direction around the normal line of the circumferential surface of the photoconductive drum 220 is a direction indicated by an arrow in FIG. 4 or a reverse direction thereof.

As shown in FIG. 4, the carrying member 202 is touched by two bolts 2021 and 2022 attached to a fixing plate 2024 fixed to the charging case 200*a*, whereby one surface of the carrying member 202 is pressed and the other surface thereof is pressed due to the reaction of a spring 2023. By increasing pressing force due to the bolts 2021 and 2022, it is possible to cause the carrying member 202 to slide on the slope surface 207. Furthermore, the carrying member 202 can be rotated around the normal line of the outer circumferential surface of the photoconductive drum 220 by increasing the pressing pressure of one of two bolts 2021 and 2022 over that of the other.

Thus, the bolts 2021 and 2022, the spring 2023 and the slope surface 207 constitute a distance adjusting mechanism that changes the distance between the carrying member 202 and the photoconductive drum 220 to adjust a relative distance between the grid 201 and the photoconductive drum 220. Furthermore, the bolts 2021 and 2022 and the spring 2023 constitute a curvature adjusting mechanism that changes the curvature of the portion of the carrying member 202 carrying the grid 201 to adjust the curvature of the curvature surface of the grid 201.

The wire 204 is carried in the wire carrying member 205 so as to be parallel to the curvature surface of the grid 201, and both ends of the wire 204 are supported by the wire supporting member 206 via the spring. The wire carrying member 205 and the wire supporting member 206 are fixed to the charging case 200*a*.

The charging case 200*a* is supported movably in the sub-scanning direction of the photoconductive drum 220 with respect to the shield case 200*b*. One side surface of the charging case 200*a* is touched and pressed by a bolt 2001 attached to one side surface of the shield case 200*b*, the other side surface of the charging case 200*a* is pressed by reaction of a spring 2002 attached to the other side surface of the shield case 200*b*, and thus the charging case 200*a* is supported. Furthermore, the charging case 200*a* can be moved in the sub-scanning direction of the photoconductive drum 220 by increasing the pressing force by the bolts 2001. Thus, the shield case 200*b*, the bolt 2001 and the spring 2002 constitute a position adjusting mechanism that moves the carrying member 202 together with the charging case 200*a* to adjust the position of the grid 201 to the photoconductive drum 220 in the sub-scanning direction.

With the charging device 200 according to the present embodiment, it is possible to accurately adjust the distance between the outer circumferential surface of the photoconductive drum 220 and the curvature surface of the grid 201 as below.

When rotating the carrying member 202 carrying the grid 201 around the normal line of the outer circumferential surface of the photoconductive drum 220 at the end part of the grid 201, it is possible to change the angle between the portion of the carrying member 202 carrying the grid 201 and the longitudinal direction of the grid 201. As a result, since it is possible to change the curvature of the portion of the carrying member 202 carrying the grid 201, the curvature of the grid 201 placed to oppose the photoconductive drum 220 can be adjusted. Thus, it is possible to accurately adjust the distance between the outer circumferential surface of the photoconductive drum 220 and the curvature surface of the grid 201.

Furthermore, by causing the carrying member 202 to slide on the slope surface 207, the relative distance between the carrying member 202 and the photoconductive drum 220 can be changed. Accordingly, it is possible to accurately adjust the distance between the outer circumferential surface of the photoconductive drum 220 and the curvature surface of the grid 201.

When moving the charging case 200*a* carrying the grid 201 by the carrying member 202 with respect to the shield case 200*b* in the sub-scanning direction of the photoconductive drum 220, the grid 201 can be relatively moved in the sub-scanning direction of the photoconductive drum 220. Thus, by changing the relative position between the photoconductive drum 220 and the grid 201, it is possible to accurately adjust the distance between the outer circumferential surface of the photoconductive drum 220 and the curvature surface of the grid 201.

In order to have the uniform curvature surface over the entire grid 201, the carrying member 202, the position adjusting mechanism, the curvature adjusting mechanism, and the distance adjusting mechanism are preferably provided in both end parts in the main scanning direction in the charging device 200.

Figure 6:
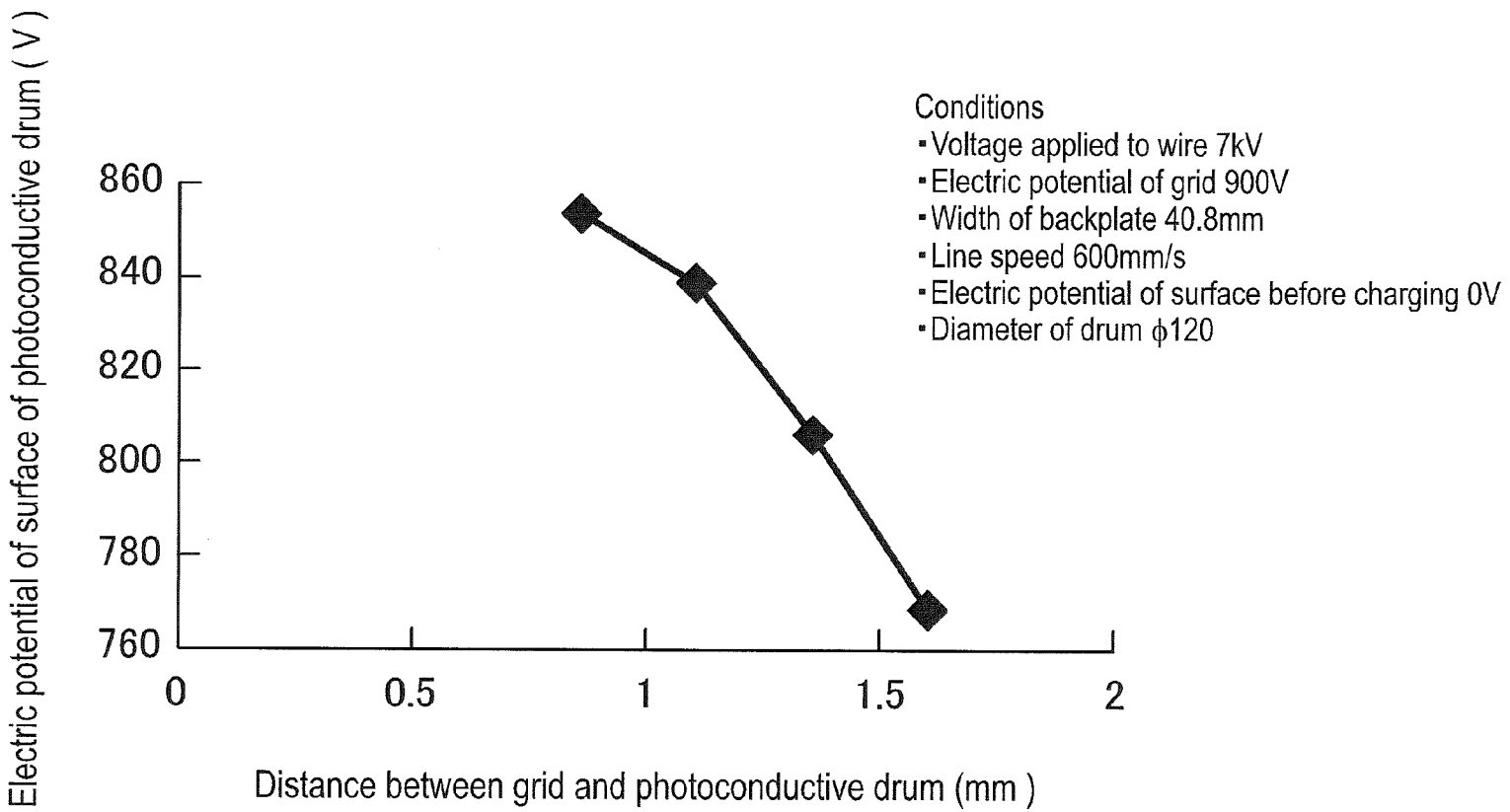
FIG. 6 is a graph that shows a relationship between a distance between the grid and the photoconductive drum and an electric potential of an outer circumferential surface of the photoconductive drum.

FIG. 6 is a graph that shows a relationship between the distance between the grid and the photoconductive drum and the electric potential of the outer circumferential surface of the photoconductive drum.

Charging of the photoconductive drum 220 using the charging device 200 is performed as below.

When high voltage is applied to the wire 204, corona discharge occurs due to the electric potential difference between the wire 204 and the grid 201, and ions are generated. The ions reach the photoconductive drum 220 via the grid 201, and charge the portion of the photoconductive drum 220 facing the curvature surface of the grid 201. In so doing, by rotating the photoconductive drum in the sub-scanning direction, the entire outer circumferential surface of the photoconductive drum 220 can be charged.

As shown in FIG. 6, as bringing the grid 201 more closer to the photoconductive drum 220, the electric potential of the outer circumferential surface of the photoconductive drum (hereinafter, referred to as an "outer circumferential surface electric potential") is increased, and thus charging efficiency can be improved. Thus, in order to improve the charging efficiency, it is preferable to further reduce the distance between the curvature surface of the grid 201 and the outer circumferential surface of the photoconductive drum 220. The charging efficiency is a ratio of the outer circumferential surface electric potential to the voltage applied to the wire 204. Thus, an increase in the outer circumferential surface electric potential shows an improvement in the charging efficiency.

Meanwhile, when the grid 201 is brought too close to the photoconductive drum 220, electricity leaks to the photoconductive drum 220, and thus the photoconductive drum 220 and the grid 201 are damaged. Thus, in the adjustment of the distance between the curvature surface of the grid 201 and the outer circumferential surface of the photoconductive drum 220, there is a need to maintain the distance between the grid 201 and the photoconductive drum 220 at a distance not generating leaking at all locations of the curvature surface of the grid 201 facing the outer circumferential surface of the photoconductive drum 220.

However, the respective errors of (1) an error due to the influence of the stress of pressing in the carrying part to the surface of the grid 201, (2) an assembly error, and (3) accumulated errors of the component deteriorate the accuracy of the distance between the curvature surface of the grid 201 and the outer circumferential surface of the photoconductive drum 220 after the apparatus is assembled. For this reason, in order to absorb such errors and reduce the distance between the curvature surface of the grid 201 and the outer circumferential surface of the photoconductive drum 220, there is a need to adjust the distance between the grid 201 and the photoconductive drum 220 in the state after the apparatus is assembled.

According to the charging device related to the present embodiment, the curvature of the portion of the carrying member carrying the grid, the relative distance between the carrying member and the photoconductive drum, and the relative position of the carrying member in the sub-scanning direction of the photoconductive drum are variable. As a result, in the state after the apparatus is assembled, it is possible to adjust the curvature of the grid, the relative distance between the grid and the photoconductive drum, and the relative position of the grid in the sub-scanning direction of the photoconductive drum. Thus, it is possible to more accurately adjust the distance between the outer circumferential surface of the photoconductive drum and the curvature surface of the grid, and thus it is possible to realize an improvement in charging efficiency, and in addition, higher resolutions, higher speeds, and further miniaturization of the image forming apparatus.

(Second Embodiment)

Figure 7:
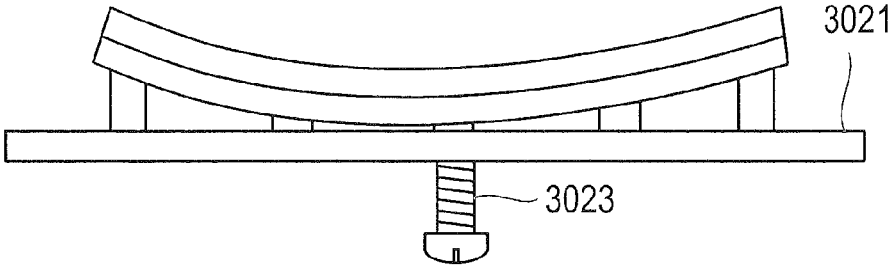
FIG. 7 is a front view and a perspective view that shows a carrying member and a plate spring of a charging device according to a second embodiment of the present invention.
Figure 7:
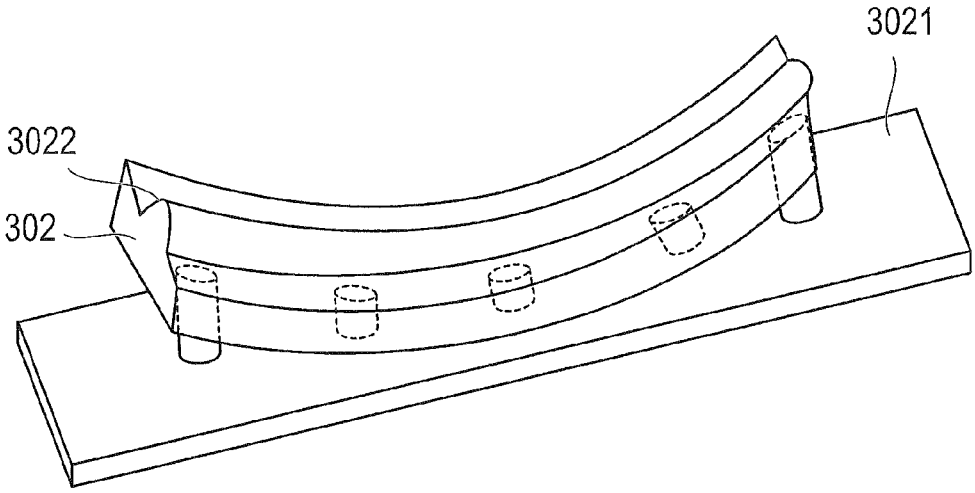
Figure 8:
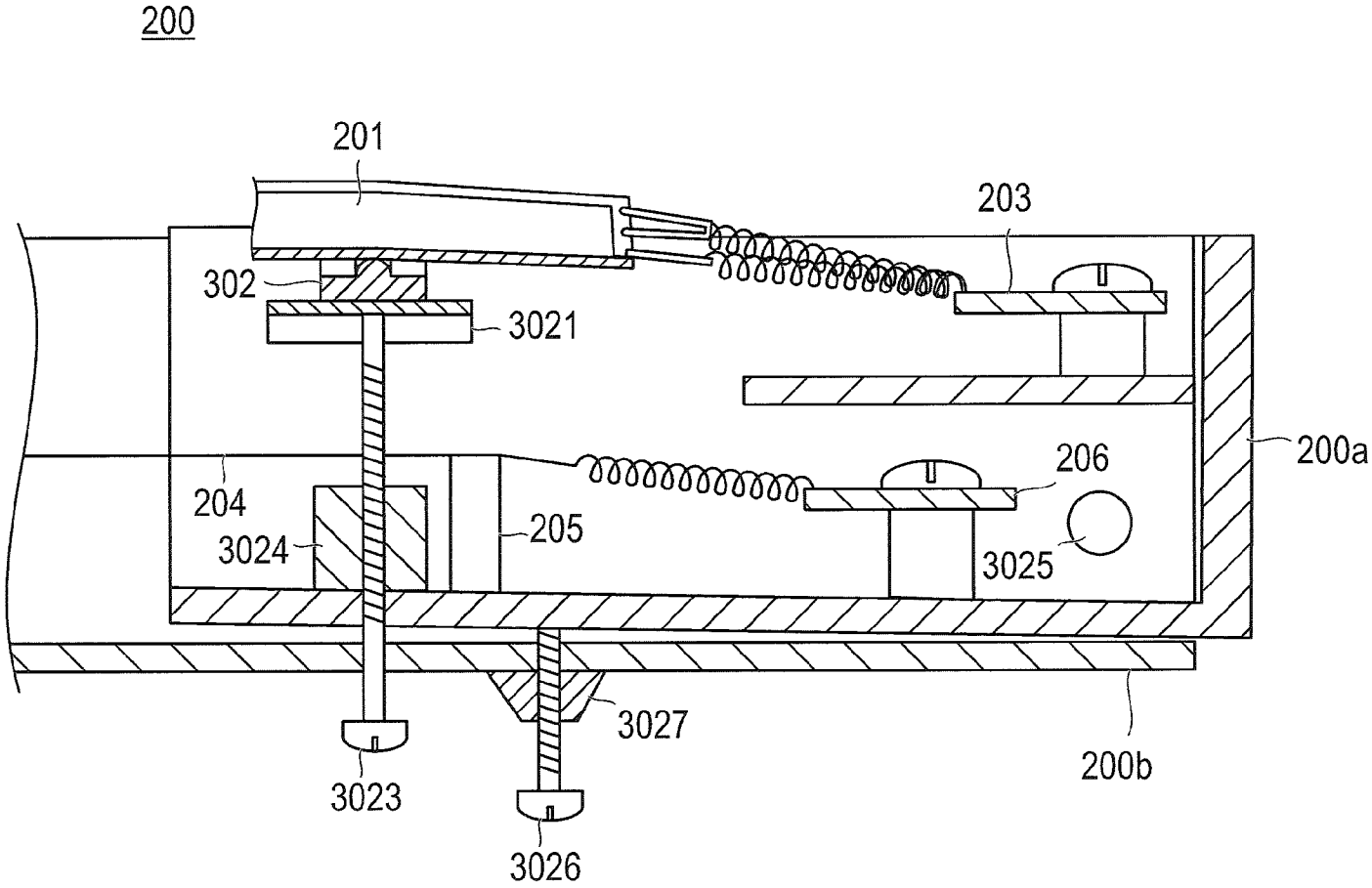
FIG. 8 is a cross-sectional view that shows a part of a charging device according to the second embodiment of the present invention.

FIG. 7 is a front view and a perspective view that shows a carrying member and a plate spring of a charging device according to a second embodiment of the present invention. FIG. 8 is a cross-sectional view that shows a part of the charging device according to the present embodiment.

The present embodiment is different from the first embodiment in the following point. That is, in the first embodiment, by rotating the carrying member constituted by a fixed shape member having curvature, the curvature of the portion carrying the grid is changed. Meanwhile, in the present embodiment, an elastic body having curvature is used in the carrying member and is elastically deformed by external force to change the curvature of the portion carrying the grid. Furthermore, in the first embodiment, by causing the carrying member to slide on the slope surface, the relative distance between the carrying member and the photoconductive drum is changed. Meanwhile, in the present embodiment, by rotating the charging case supporting the carrying member with respect to the shield case, the relative distance between the carrying member and the photoconductive drum is changed. Since other points are the same as those of the first embodiment, a repeated description will be omitted.

The bottom surface of the carrying member 302 of the charging device 200 is fixed to a plate spring 3021. The carrying member 302 is an elastic body, and a projected portion 3022 carrying the grid 201 has a curvature shape. When bringing the bolt 3023 into contact with the center of the plate spring 3021 and pressing the bolt 3023, the plate spring 3021 can be curved. As a result, by elastically deforming the carrying member 302, the bottom surface of which is fixed to the plate spring 3021, the curvature of the curvature shape can be changed. Accordingly, it is possible to change the curvature of the portion 3022 carrying the grid 201.

The bolt 3023, which comes into contact with the plate spring 3021 and is pressed, is attached to a fixture 3024 fixed to the charging case 200*a* (FIG. 8). Both ends of the plate spring 3021 are supported by the charging case 200*a*. For example, both ends of the plate spring 3021 are inserted into the holes provided in the charging case 200*a*, and both ends are bent, and thus the plate spring 3021 can be supported by the charging case 200*a*.

Thus, the plate spring 3021, the bolt 3023, and the fixture 3024 constitute a curvature adjusting mechanism which changes the curvature of the portion 3022 of the carrying member 302 carrying the grid 201 to adjust the curvature of the curvature surface of the grid 201.

The charging case 200*a* is supported on the shield case 200*b* rotatably around a shaft 3025. For this reason, for example, by causing the shaft 3025 fixed between the left and right side surfaces of the shield case 200*b* to pass through the hole provided on the left and right side surfaces of the charging case 200*a* with having looseness, the charging case 200*a* may be attached to the shield case 200*b*.

By bringing the bolt 3026 attached to the fixture 3027 fixed to the shield case 200*b* into contact with the bottom surface of the charging case 200*a* and pressing the bolt 3026, the charging case 200*a* can be rotated around the shaft 3025 to the shield case 200*b*. As a result, it is possible to change the relative distance between the carrying member 302 and the photoconductive drum 220 supported by the charging case 200*a*.

In addition, in order to obtain a reaction from the upper surface of the charging case 200*a* with respect to the pressing to the bottom surface of the charging case 200*a* by using the bolt 3026, an L-shaped plate spring (not shown), whose one end is fixed to the charging case 200*a* and the other end comes into contact with a suitable location of the upper surface of the charging case 200*a*, maybe provided. As a result, it is possible to stabilize the rotation movement of the charging case 200*a* with respect the shaft 3025.

Thus, the charging case 200*a*, the shaft 3025, the bolt 3026, and the fixture 3027 constitute a distance adjusting mechanism which changes the relative distance between the carrying member 302 and the photoconductive drum 220 to adjust the relative distance between the grid 201 and the photoconductive drum 220.

With the charging device 200 according to the present embodiment, the distance between the photoconductive drum 220 and the grid 201 can be adjusted as below.

By elastically deforming the carrying member 302 carrying the grid 201 to change the curvature of the curvature shape thereof, it is possible to change the curvature of the portion of the carrying member 302 carrying the grid 201. As a result, the curvature of the curvature surface of the grid 201 is adjusted and thus it is possible to accurately adjust the distance between the outer circumferential surface of the photoconductive drum 220 and the curvature surface of the grid 201.

Furthermore, by rotating the charging case 200*a* around the shaft 3025 with respect to the shield case 200*b*, it is possible to change the relative distance between the carrying member 302 supported by the charging case 200*a* and the photoconductive drum 220. As a result, it is possible to accurately adjust the distance between the outer circumferential surface of the photoconductive drum 220 and the curvature surface of the grid 201.

In addition, even in the present embodiment, as in the first embodiment, it is possible to provide the position adjusting mechanism which adjusts the position of the grid 201 in the sub-scanning direction of the photoconductive drum 220.

According to the charging device related to the present embodiment, the curvature of the portion of the carrying member carrying the grid, the distance between the carrying member and the photoconductive drum, and the position of the carrying member in the sub-scanning direction of the photoconductive drum are variable. As a result, it is possible to adjust the curvature of the grid, the relative distance between the grid and the photoconductive drum, and the relative position of the grid in the sub-scanning direction of the photoconductive drum. Thus, it is possible to more accurately adjust the distance between the outer circumferential surface of the photoconductive drum and the curvature surface of the grid, and thus it is possible to realize an improvement in charging efficiency, and in addition, higher resolutions, higher speeds, and further miniaturization of the image forming apparatus.

(Third Embodiment)

Figure 9:
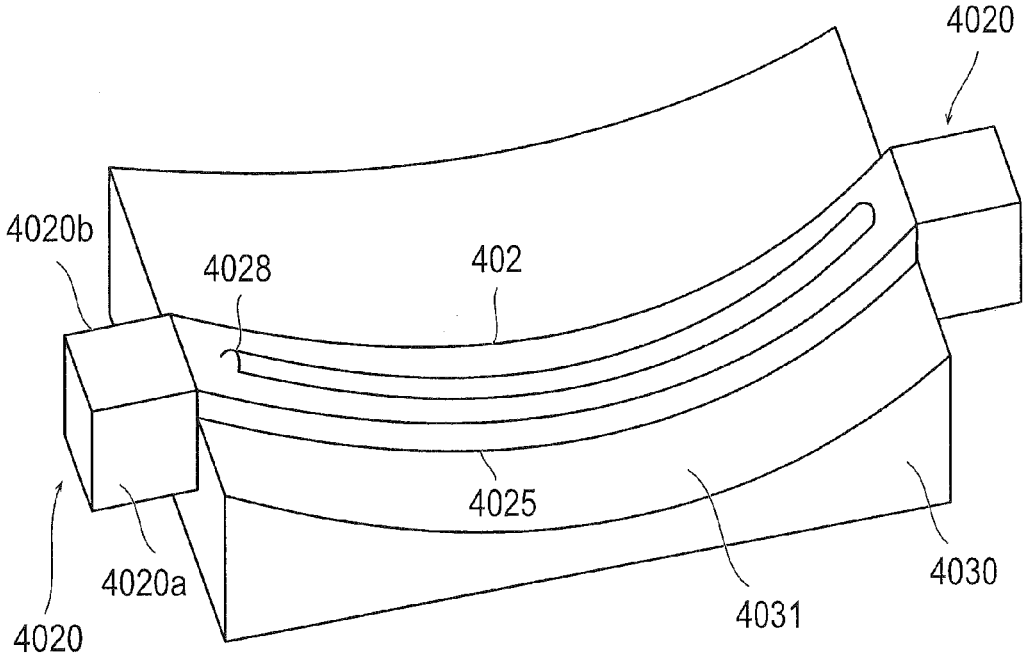
FIG. 9 is a perspective view that shows a carrying member of a charging device and a curvature guide surface according to a third embodiment of the present invention.
Figure 10:
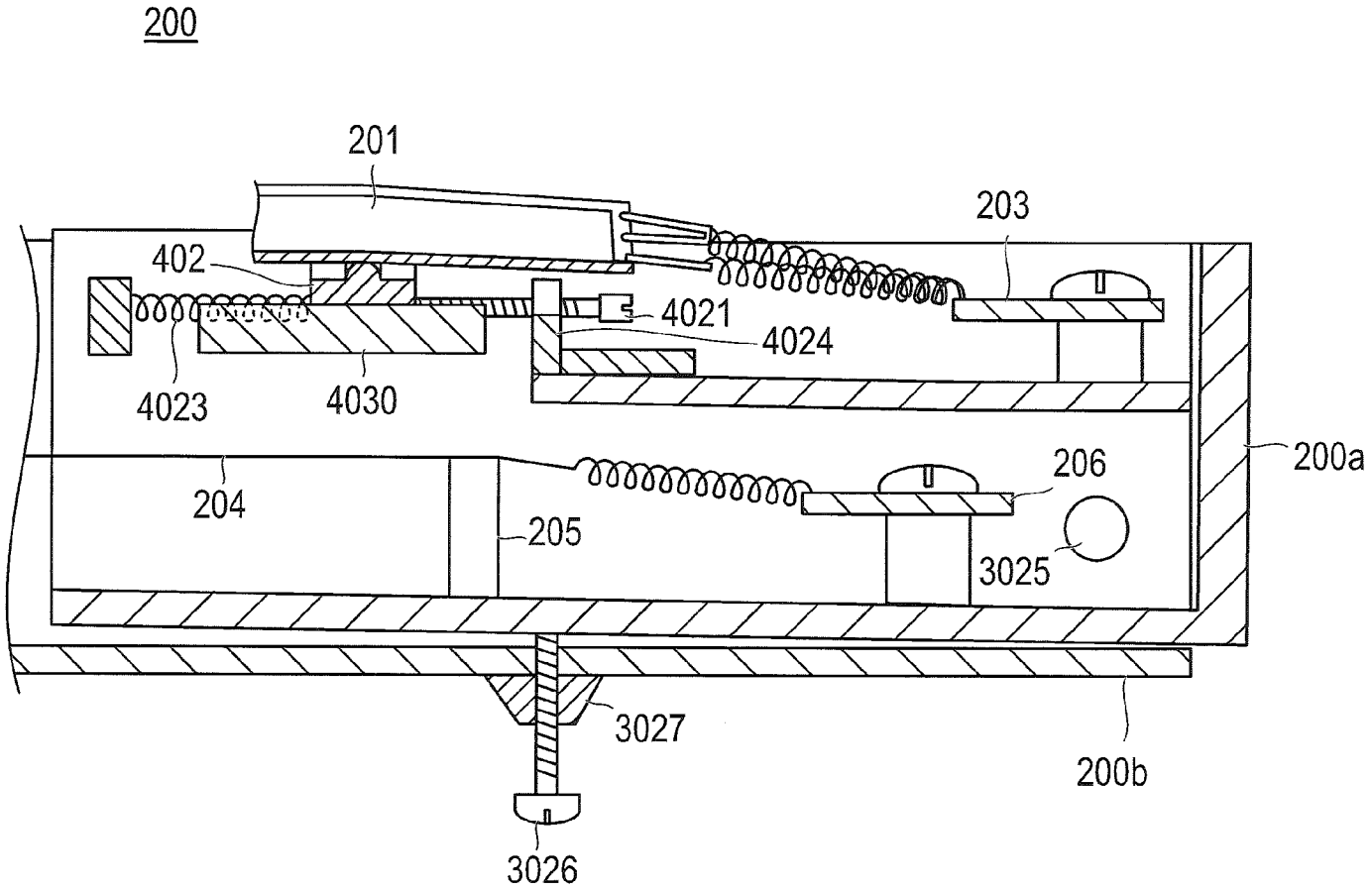
FIG. 10 is a cross-sectional view that shows a part of the charging device according to the third embodiment of the present invention.

FIG. 9 is a perspective view that shows a carrying member and a curvature guide surface of a charging device according to a third embodiment of the present invention. FIG. 10 is a cross-sectional view that shows a part of the charging device according to the present embodiment.

The present embodiment is different from the first embodiment in the next point. That is, in the first embodiment, by rotating the carrying member constituted by a fixed form member having curvature, the curvature of the portion carrying the grid is changed. Meanwhile, in the present embodiment, by causing the carrying member having curvature to slide while being pressed against the curvature guide surface which the curvature is gradually changed, the carrying member is deformed to change the curvature of the portion carrying the grid. Furthermore, in the first embodiment, by causing the carrying member to slide on the slope surface, the relative distance between the carrying member and the photoconductive drum is changed. Meanwhile, in the present embodiment, as in the second embodiment, by rotating the charging case supporting the carrying member with respect to the shield case, the relative distance between the carrying member and the photoconductive drum is changed. Since the other points are the same as those of the first embodiment, a repeated description will be omitted.

The carrying member 402 is hooked to the curvature guide member 4030 so that a bottom surface 4025 comes into contact with the curvature guide surface 4031 of the curvature guide member 4030 and an attachment part 4020 comes into contact with the side surface of the curvature guide member 4030. The curvature guide surface 4031 has a shape whose curvature of the cross-section is gradually changed. The carrying member 402 has a portion 4028 having a projected curvature shape on the upper surface thereof and carrying the grid 201.

As shown in FIG. 10, one surface 4020*a* of the carrying member 402 is pressed by being touched by the bolt 4021 attached to the fixing plate 4024, and the other surface 4020*b* of the carrying member 402 is pressed by reaction of the spring 4023. As a consequence, the carrying member 402 is supported on the curvature guide surface 4031 by the bolt 4021 and the spring 4023. Furthermore, by increasing or decreasing pressing force due to the bolt 4021 in this state, the carrying member 402 can slide on the curvature guide surface 4031. In so doing, since the carrying member 402 carries the grid 201, the carrying member 402 is pressed by tension of the grid 202, is pressed to the curvature guide surface 4031, and is deformed to have the same curvature as that of the curvature guide surface 4031. As a result, it is possible to change the curvature of the portion 4028 of the carrying member 402 carrying the grid 201 according to the curvature of the cross-section of the curvature guide surface 4031.

Thus, the curvature guide surface 4031, the bolt 4021, and the spring 4023 constitute a curvature adjusting mechanism that changes the curvature of the portion 4028 of the carrying member 402 carrying the grid 201 to adjust the curvature of the curvature surface of the grid 201.

The charging device 200 according to the present embodiment has the distance adjusting mechanism that adjusts the relative distance between the grid 201 and the photoconductive drum 220 as in the second embodiment. Since the distance adjusting mechanism is the same as that of the second embodiment, the description thereof will be omitted.

In addition, even in the present embodiment, as in the first embodiment, it is possible to provide the position adjusting mechanism which adjusts the position of the grid 201 in the sub-scanning direction of the photoconductive drum 220.

According to the charging device related to the present embodiment, the curvature of the portion of the carrying member carrying the grid, the distance between the carrying member and the photoconductive drum, and the position of the carrying member in the sub-scanning direction of the photoconductive drum are variable. As a result, it is possible to adjust the curvature of the grid, the relative distance between the grid and the photoconductive drum, and the relative position of the grid in the sub-scanning direction of the photoconductive drum. Thus, it is possible to more accurately adjust the distance between the outer circumferential surface of the photoconductive drum and the curvature surface of the grid, and thus it is possible to realize an improvement in charging efficiency, and in addition, higher resolutions, higher speeds, and further miniaturization of the image forming apparatus.

(Fourth Embodiment)

Figure 11:
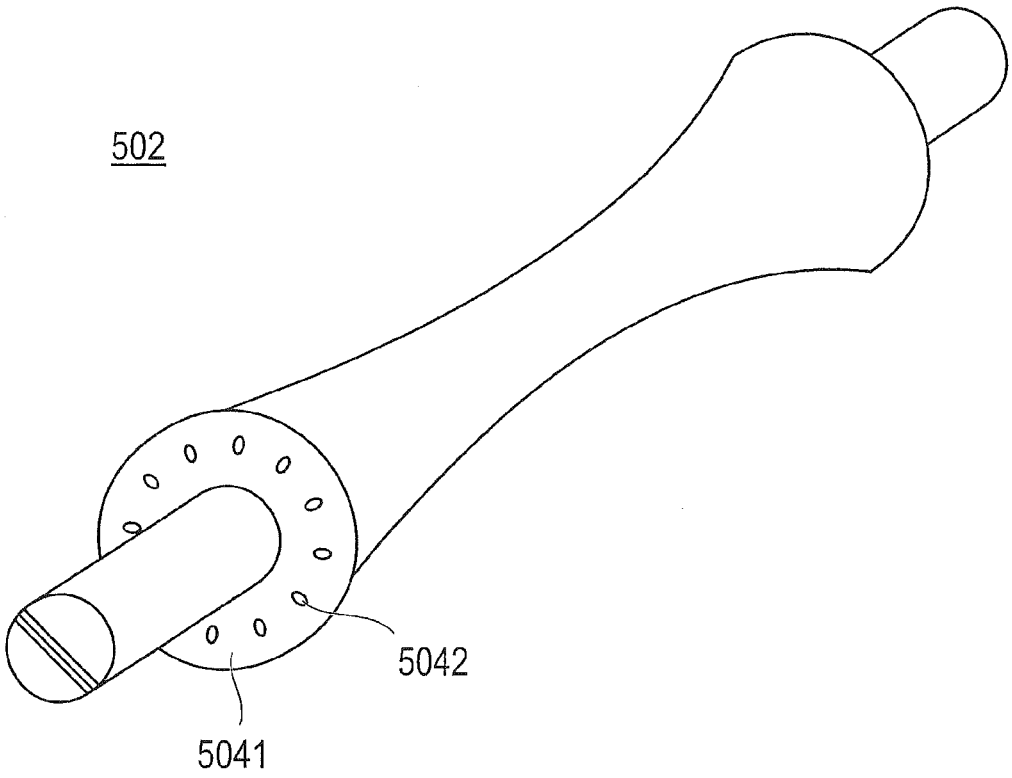
FIG. 11 is a perspective view that shows a carrying member of a charging device according to a fourth embodiment of the present invention.
Figure 12:
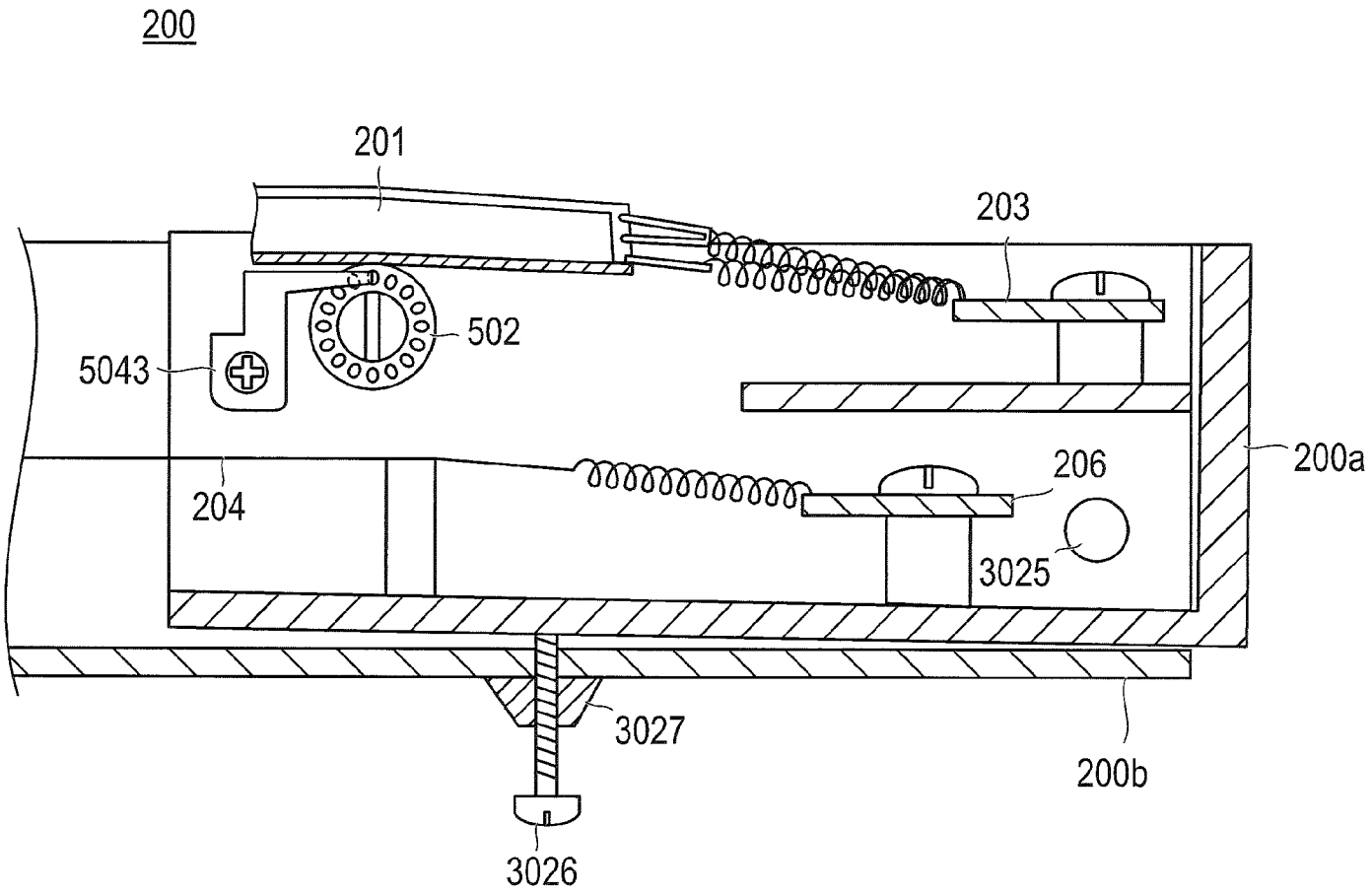
FIG. 12 is a cross-sectional view that shows a part of the charging device according to the fourth embodiment of the present invention.

FIG. 11 is a perspective view that shows a carrying member of a charging device according to a fourth embodiment of the present invention. FIG. 12 is a cross-sectional view that shows a part of the charging device according to the present embodiment.

The present embodiment is different from the first embodiment in the next point. That is, in the first embodiment, by rotating the carrying member constituted by a fixed shape member having curvature, the curvature of the portion carrying the grid is changed. Meanwhile, in the present embodiment, by rotating a cylindrical carrying member having an outer circumferential surface whose curvature in the axial direction is changed in the rotation direction of the shaft, the curvature of the portion carrying the grid is changed. Furthermore, in the first embodiment, by causing the carrying member to slide on the slope surface, the relative distance between the carrying member and the photoconductive drum is changed. Meanwhile, in the present embodiment, as in the second embodiment, by rotating the charging case supporting the carrying member with respect to the shield case, the relative distance between the carrying member and the photoconductive drum is changed. Since other points are the same as those of the first embodiment, a repeated description will be omitted.

A carrying member 502 has a cylindrical shape, has the curvature in the axial direction thereof, and has an outer circumferential surface in which the curvature in the axial direction is changed in the rotation direction with respect the shaft. Furthermore, the carrying member 502 has a plurality of holes 5042 in at least one of a side surface 5041 thereof. The tip of a plate spring 5043 serving as a rotation stopper is inserted to the holes 5042 to stop the rotation of the carrying member 502 with respect the shaft.

The end part of the carrying member 502 is rotatably supported by the charging case 200*a*. For example, the respective end parts of the carrying member 502 may be each inserted to two holes provided on the side surface of the charging case 200*a*, such that the carrying member 502 may be rotatably supported by the holes.

The grid 201 is pressed by the carrying member 502 by being carried on the carrying member 502, and is deformed so as to have the curvature of the portion of the carrying member 502 carrying the grid 201. Thus, since the curvature of the portion of the carrying member 502 carrying the grid 201 can be changed by rotating the carrying member 502 around the shaft, the curvature of the grid 201 can be changed.

The one end of the plate spring 5043 is fixed to the charging case 200*a* and the other end thereof is inserted to any one of the holes 5042 of the carrying member 502. As a result, it is possible to fix the carrying member 502 to a rotation angle when the portion of the carrying member 502 carrying the grid 201 has a desired curvature.

Thus, the outer circumferential surface of the carrying member 502 and the plate spring 5043 constitute a curvature adjusting mechanism that changes the curvature of the portion 5028 of the carrying member 502 carrying the grid 201 to adjust the curvature of the curvature surface of the grid 201.

The charging device 200 according to the present invention can have the distance adjusting mechanism that adjusts the relative distance between the grid 201 and the photoconductive drum 220 as in the second embodiment. Since the distance adjusting mechanism is the same as that of the second embodiment, a description thereof will be omitted.

Furthermore, even in the present embodiment, as in the first embodiment, it is possible to provide the position adjusting mechanism which adjusts the position of the grid 201 in the sub-scanning direction of the photoconductive drum 220.

According to the charging device related to the present embodiment, the curvature of the portion of the carrying member carrying the grid, the distance between the carrying member and the photoconductive drum, and the position of the carrying member in the sub-scanning direction of the photoconductive drum are variable. As a result, it is possible to adjust the curvature of the grid, the relative distance between the grid and the photoconductive drum, and the relative position of the grid in the sub-scanning direction of the photoconductive drum. Thus, it is possible to more accurately adjust the distance between the outer circumferential surface of the photoconductive drum and the curvature surface of the grid, and thus it is possible to realize an improvement in charging efficiency, and in addition, higher resolutions, higher speeds, and further miniaturization of the image forming apparatus.

(Fifth Embodiment)

Figure 13:
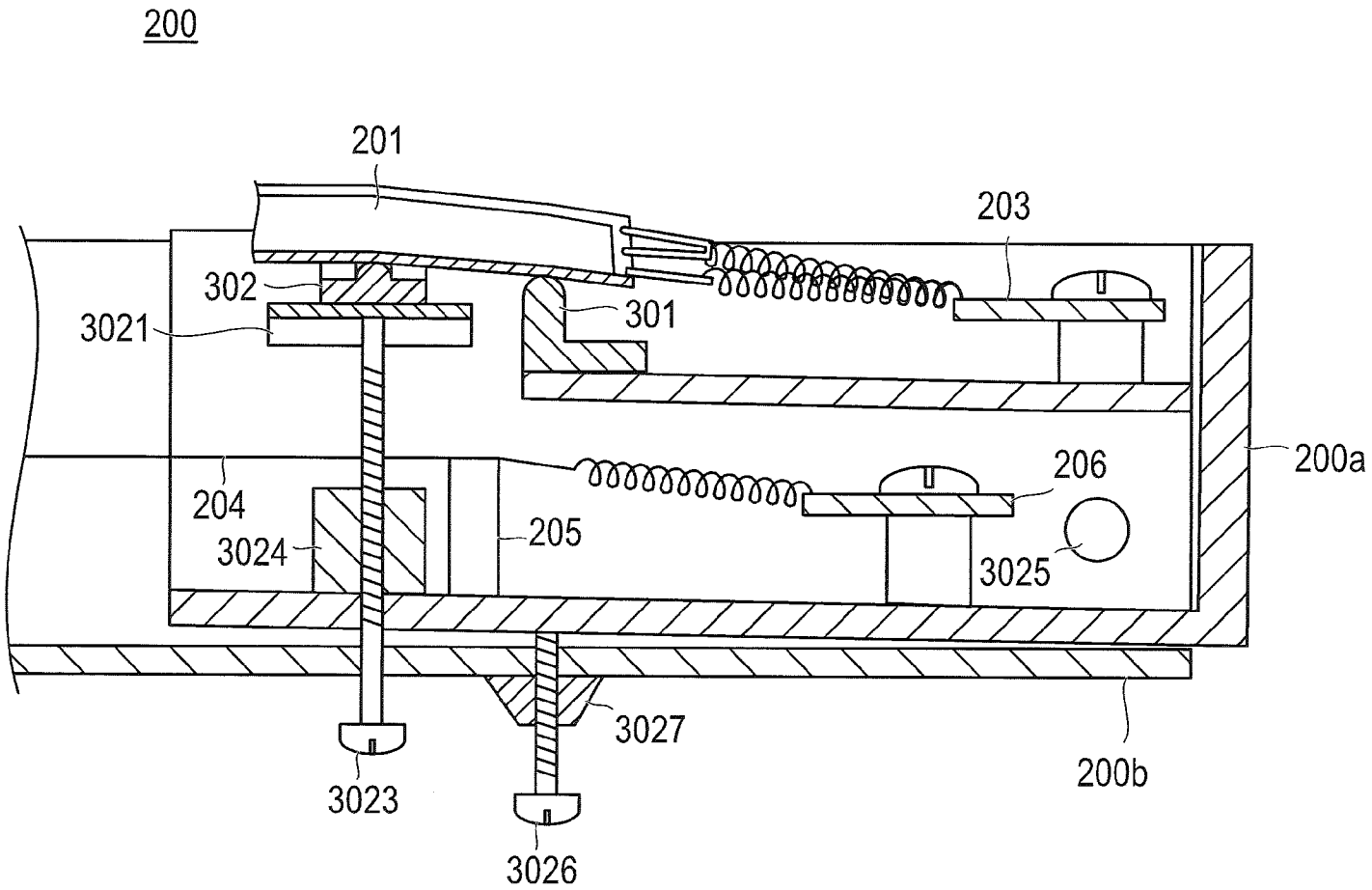
FIG. 13 is a cross-sectional view that shows a part of a charging device according to a fifth embodiment of the present invention.

FIG. 13 is a cross-sectional view that shows a part of a charging device according to a fifth embodiment of the present invention.

The present embodiment is different from the first to fourth embodiments in that, in the present embodiment, as a member carrying the grid, in addition to the carrying member, an auxiliary carrying member having a curvature shape greater than that of the carrying member is provided outside the grid with respect to the carrying member. Since other points are the same as those of the first to fourth embodiments, a repeated description will be omitted.

FIG. 13 shows a configuration in which an auxiliary carrying member 301 is provided in the charging device 200 according to the second embodiment. The charging device 200 according to the present embodiment further includes an auxiliary carrying member 301 whose curvature of a portion carrying the grid 201 is greater than that of the carrying member 302, between the carrying member 302 and the supporting member 203 supporting both ends of the grid 201. That is, the end part of the grid 201 is carried by the auxiliary carrying member 301 having a curvature greater than that of the carrying member 302, and is carried by the carrying member 302 provided inside the grid 201 with respect to the auxiliary carrying member 301. The auxiliary carrying member 301 is fixed to the charging case 200*a*.

Since the grid 201 is pressed and bent due to tension of the grid 201 in the portion of the carrying member 302 carrying the grid 201, the curvature surface of the grid 201 is deformed so as to be a slightly more complicated wave, and thus the curvature shape of the grid 201 may be disturbed.

In the charging device 200 according to the present embodiment, by carrying the grid 201 by the auxiliary carrying member 301, the grid 201 is molded in a relatively great curvature shape. Moreover, by carrying the grid 201 by the carrying member 302 provided inside the grid 201 with respect to the auxiliary carrying member 301, the disturbance of the curvature shape of the grid 201 is corrected, and the curvature of the curvature surface of the grid 201 is adjusted. As a result, by localizing the complicated deformed portion of the grid 201 between the carrying member 302 and the auxiliary carrying member 301, the disturbance of the curvature shape of the grid 201 can be suppressed.

Thus, with the charging device according to the present embodiment, by suppressing the disturbance of the grid that could occur by being carried by the carrying member, accurate adjustment of the curvature of the grid is possible. As a result, it is possible to more accurately adjust the distance between the outer circumferential surface of the photoconductive drum and the curvature surface of the grid, and thus it is possible to realize an improvement in charging efficiency, and in addition, higher resolutions, higher speeds, and further miniaturization of the image forming apparatus.

Although the charging device, the imaging cartridge, and the image forming apparatus having the charging device according to the present embodiment have been described, the charging device, the imaging cartridge, and the image forming apparatus having the charging device according to the present invention are not limited to the embodiments mentioned above.

For example, in the embodiments mentioned above, the bolt attached to the shield case comes into contact with one side surface of the charging case and is pressed, and the other side surface thereof is pressed by reaction of the spring attached to the shield case, whereby the charging case is supported movably in the sub-scanning direction of the photoconductive drum. However, such a bolt and spring may be provided in a fixture other than the shield case.

What is claimed is:

1. A charging device for use with a photoconductive drum, the charging device comprising:

a grid that has a curvature surface curved in a sub-scanning direction of the photoconductive drum and placed to face an outer circumferential surface of the photoconductive drum;

a carrying member that carries said grid in a portion having a curvature to form said curvature surface of said grid;

a position adjusting mechanism that moves a position of said carrying member to adjust a position of said grid in the sub-scanning direction of said photoconductive drum;

a supporting member that supports both ends of said grid; and an auxiliary carrying member whose curvature of the portion carrying said grid is greater than the curvature of said carrying member, between said carrying member and said supporting member.

2. The charging device as claimed in claim 1 further comprising:

a curvature adjusting mechanism that changes a curvature of a portion of said carrying member carrying said grid to adjust a curvature of said curvature surface of said grid.

3. The charging device as claimed in claim 1 further comprising:

a distance adjusting mechanism that changes a distance between said carrying member and said photoconductive drum to adjust a distance between said grid and said photoconductive drum.

4. The charging device as claimed in claim 3 wherein said carrying member is slidably supported on a slope surface tilted to a surface perpendicular to said normal line of said outer circumferential surface of said photoconductive drum, and said distance adjusting mechanism causes said carrying member to slide on said slope surface to adjust the distance between said grid and said photoconductive drum.

5. The charging device as claimed in claim 3 wherein said carrying member, said position adjusting mechanism, and said distance adjusting mechanism are provided on both end portions of the charging device in a main scanning direction.

6. An imaging cartridge comprising:

the charging device as claimed in claim 1;

an optical writing part that forms as electrostatic latent image on a photoconductive drum; and a developing device that develops said electrostatic latent image.

7. An image forming apparatus comprising:

the charging device as claimed in claim 1.

8. A charging device for use with a photoconductive drum, comprising:

a grid that has a curvature surface curved in a sub-scanning direction of the photoconductive drum and placed to face an outer circumferential surface of the photoconductive drum;

a carrying member that carries said grid in a portion having a curvature to form said curvature surface of said grid; and a curvature adjusting mechanism that changes the curvature of a portion of said carrying member carrying said grid to adjust a curvature of said curvature surface of said grid;

wherein said carrying member has a predetermined curvature shape, and said curvature adjusting mechanism changes the curvature of the portion of said carrying member carrying said grid to adjust the curvature of said curvature surface of said grid, by rotating said carrying member around a normal line of said outer circumferential surface of said photoconductive drum.

* * * * *